United States Patent [19]

Kim

[11] Patent Number: 4,802,051

[45] Date of Patent: Jan. 31, 1989

[54] ARC-FREE ELECTROMAGNETIC CONTACTOR

[76] Inventor: In Suk Kim, Samik Apt 10-615 Chungdamdong 134-21, Kangnam-ku, Seoul, Rep. of Korea

[21] Appl. No.: 56,851

[22] Filed: Jun. 1, 1987

[30] Foreign Application Priority Data

Jun. 2, 1986 [KR] Rep. of Korea ..... 1986-4347

[51] Int. Cl.[4] ..... H01H 9/30

[52] U.S. Cl. ..... 361/13; 361/2; 307/134

[58] Field of Search ..... 361/2, 13; 302/134

[56] References Cited

U.S. PATENT DOCUMENTS

| | | | |
|---|---|---|---|
| 3,539,775 | 10/1970 | Casson | 361/13 |
| 3,555,353 | 1/1971 | Casson | 361/13 |
| 3,558,910 | 1/1971 | Dale | 307/134 |
| 3,736,446 | 5/1973 | Berlincourt et al. | 310/368 |
| 3,868,349 | 2/1975 | Schaefer et al. | 361/13 |
| 4,626,951 | 12/1986 | Nagao | 361/13 |

FOREIGN PATENT DOCUMENTS

| | | |
|---|---|---|
| 0072566 | 8/1981 | European Pat. Off. . |
| 1238541 | 1/1965 | Fed. Rep. of Germany . |

*Primary Examiner*—A. D. Pellinen
*Assistant Examiner*—Jeffrey A. Gaffin
*Attorney, Agent, or Firm*—Michael N. Meller

[57] ABSTRACT

An electromagnetic contactor without arc generation wherein the silver contacts are omitted by providing contact portions between the fixed terminals and the movable piece to separate the semi-conductor completely from the power supply under open-circuit condition. In the contactor, the cylindrical holes are provided in each silver contact portion of the fixed terminals, the circumference of the holes being rounded to conform to the curvature radius of the contact portions which project from the conductive movable piece. The conductive pins wound by the coil springs are supported by the insulating plates to be isolated from the fixed terminals and also electrically connected via the subsidiary terminals to one terminal and a gate of a triac, respectively.

6 Claims, 4 Drawing Sheets

(B)

(C)

(D)

ARC-FREE ELECTROMAGNETIC CONTACTOR

BACKGROUND OF THE INVENTION

1. Field of the Invention

This invention relates to a general-purpose electromagnetic contactor, and more particularly to an improved electromagnetic contactor without arc generation wherein the prior art silver contacts are eliminated due to the improvement of the contact portions between the fixed terminals and a movable piece, thereby allowing the semi-conductor to separate completely from the power supply under an open-circuit condition.

2. Description of the Prior Art

It has been well-known in the art that contacts are subjected to corrosion and abrasion due to the generation of an arc to which ionizes the air between the contacts during the breaking of current, in the conventional electromagnetic contactor.

Specifically, in order to prevent the corrosion or dissolution of the contact material due to the generation of an arc through a current caused by the ionized gas between contacts, a triac is connected between the supply terminal and the load terminal in parallel, and a separate gate terminal is provided to connect them asynchronously, thereby preventing arc generation.

A number of arc-generation preventing apparatus have been proposed for protecting contacts by employing a semi-conductor device, as disclosed in U.S. Pat. Nos. 3,555,353, 3,558,910, and 3,736,446; Japanese laid-open Publication Nos. Sho 49-745, 51-118056, 52-122853 and 53-110432; and Korean Patent Application No. 84-5220 field by the inventor of the present invention. However, most of these apparatus have a drawback in that since an electric circuit provided among the power supply, the control device and the load relies on the function of breaking the inner inverse voltage thereof only, the sudden flow of power occurs between the power supply and the load if the inner voltage of the semi-conductor device is broken down due to an opening or closing operation of the power supply, thunderbolt, etc. Therefore, said apparatus did not overcome the above-mentioned problem in security and thus failed to reach the stage of practical utilization.

OBJECT OF THE INVENTION

Accordingly, it is an object of the present invention, to eliminate the above-mentioned problem in security, to provide an improved arc-free electromagnetic contactor which can reduce a contact resistance by increasing the contact area while omitting the silver contacts in the contact portion; prevent the temperature rise of the contacts caused by the flow of a great current into same; reduce the consumption of power; and protect against all accidents due to the heat generation in the contacts.

SUMMARY OF THE INVENTION

According to the present invention, cylindrical holes are provided in place of each silver contact portion of the fixed terminals, the circumference of which are rounded to fit with the radius curvature of the contact portions which are projections on the conductive movable piece; and conductive pins wound by coil springs are supported by insulating plates to be isolated from the fixed terminals and also electrically connected via the subsidiary terminals to one terminal and a gate of a triac, respectively.

BRIEF DESCRIPTION OF THE DRAWINGS

These objects and features of the present invention will become more apparent from the following description of an embodiment of the present invention with reference to the accompanying drawings wherein.

DETAILED DESCRIPTION OF THE INVENTION

Figure 1:
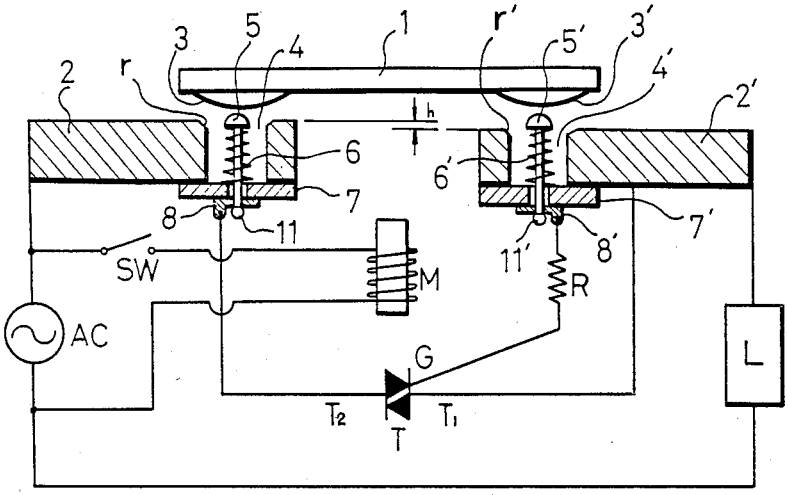
FIG. 1 illustrates a schematic diagram of an embodiment according to the present invention.
Figure 3:
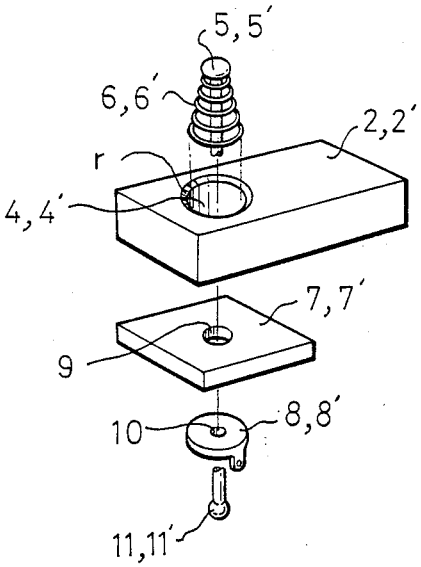
FIG. 3 is an exploded perspective view for explaining the main parts of the present invention.

Referring now to FIGS. 1 and 3, fixed terminals 2, 2' are provided with cylindrical holes 4, 4' having the same size as the prior art silver contacts in the position where the conventional contacts should be installed, and the circumference r thereof is rounded to fit with the radius of curvature of the contact portions 3, 3' which are the projections on the conductive movable piece 1.

In the interior of cylindrical holes 4, 4', conductive pins 5, 5' having coil springs 6, 6' wound therearound are supported by insulating plates 7, 7' so as to be isolated from the fixed terminals 2, 2'. Further, the ends 11, 11' of conductive pins 5, 5' are formed so that conductive pins 5, 5' are secured to subsidiary terminals 8, 8'. The terminal T2 and gate G of a triac T are connected to the subsidiary terminals 8 and 8' respectively and embedded into the frame made of synthetic resin as not shown. The level of the fixed terminal 2 is set to be higher than that of the fixed terminal 2' by a height h. It is well-known that an electromagnet M is installed in the above-mentioned frame made of synthetic resin.

Figure 2:
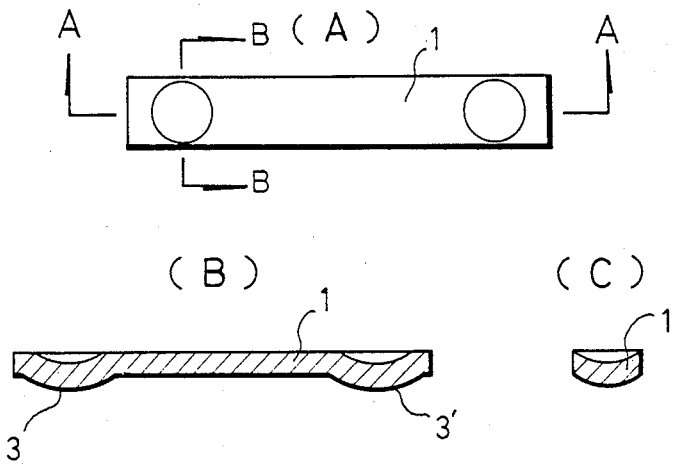
FIG. 2(A) is a plan view of the movable piece in FIG. 1.
FIGS. 2(B) and (C) are a cross-sectional view taken along a line a—a' in FIG. 2(A) and a cross-sectional view taken along a line b—b' in FIG. 2(A), respectively.

The conductive movable piece 1 in FIG. 1 is shown in such a manner that the contact portions 3, 3' project in the shape of a curved surface by the conventional silver contact portions, as shown in FIGS. 2(A) to (C). The triac T is preferably outside the synthetic resin frame.

Reference numerals 9 and 10 in the drawings represent the holes which allow the conductive pins 5 and 5' to respectively penetrate plate 7 and terminal 8 vertically; AC being a power supply; SW being a switch; R being a resistor; and L being a load.

Figure 4:
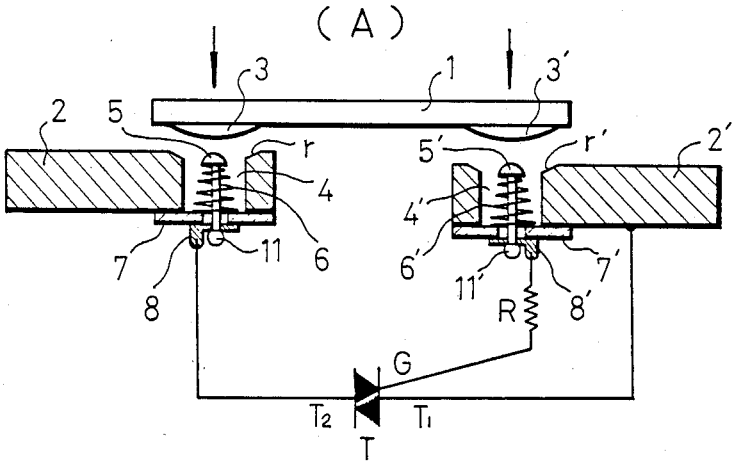
FIGS. 4(A), (B), (C) and (D) illustrate an schematic diagram for explaining an operation of an present invention.
Figure 4:
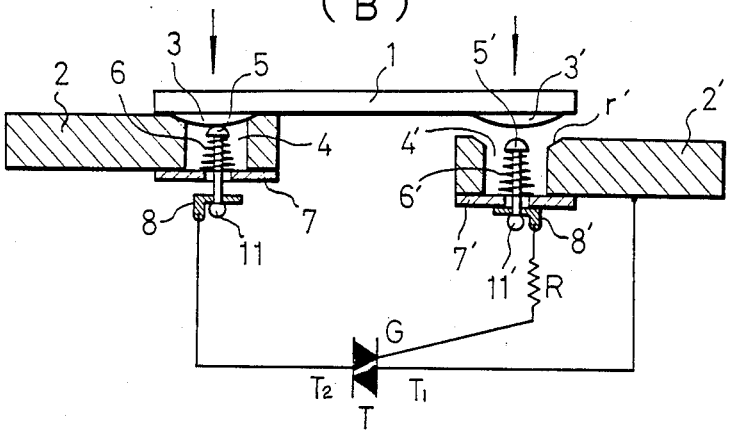
Figure 4:
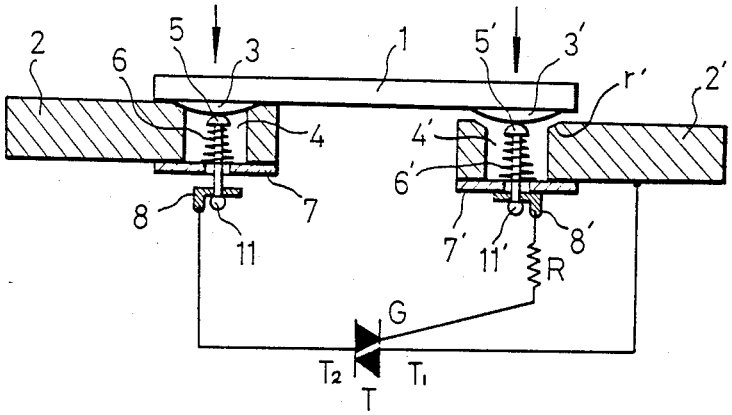
Figure 4:
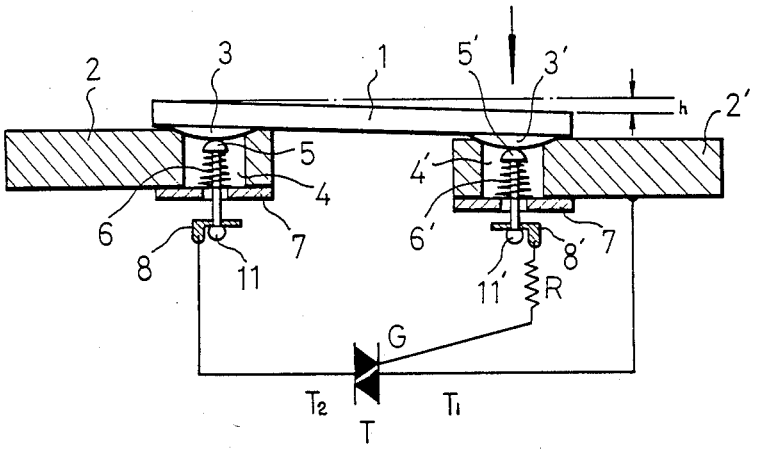

In the embodiment as described above, if a switch SW is closed to energize the electromagnet M, the movable piece 1 is attracted from the state as shown in FIG. 4(A) to the state as shown in FIG. 4(B), and thus the contact portion 3 touches the conductive pin 5 raised out of the cylindrical hole 4 of the fixed terminal 2. At the same time, the terminal T2 of triac T, the fixed terminal 2 and the movable piece 1 are connected altogether and in turn the contact point 3' of the movable piece 1 touches the tip of conductive pin 5' as shown in FIG. 4(C) to enable the gate of triac T and thereby to connect the same electrically through the triac T installed between the fixed terminals 2 and 2'. Subsequently, as the contact portion 3' of movable piece 1 pushes down the contact pin 5' as shown in FIG. 4(D), the contact pin 5' is urged against the tension of coil spring 6' to descend through hole 9 of the insulating plate 7' and thereby to touch the contact portion 3' thereof onto the circumference r of the cylindrical hole 4' of fixed terminal 2'. As a result, the current flows from fixed terminal 2 to the fixed terminal 2' through the movable piece 1 in the state when the traic T is conducting thereby not generating an arc.

Accordingly, in this state as the contact portion 3' is connected to the circumference r of the fixed terminal 2', a current flowing through load L does not go through the triac T due to an inner resistance of said triac T but goes through the movable piece 1, to thereby form a normal current path. At this time, since the entire circumference r of the cylindrical holes 4, 4' touch the contact portions 3, 3' of the movable piece 1, a current is conducted into a line contact which is enlarged by the circumference of contact portions 3, 3' (diameter thereof), so that said line contact has a lower of contact resistance than that in the conventional point contact. As a result of this, the temperature rise of the contact point due to the flowing of great current may be prevented, and it is possible to reduce the electric power consumption dramatically as well as to omit the expensive contact.

In the state of conducting into the side of load L as described above, if a switch SW is opened, then in accordance with the sequence corresponding to the reverse of the above-mentioned sequence, the contact portion 3' of the movable piece 1 is separated from a circumference r of the cylindrical hole 4' in the fixed terminal 2' so that a current having flowed through the movable piece 1 between the fixed terminals 2 and 2' conducts through the triac T, and after the lapse of instantaneous time, the contact portion 3' of the movable piece 1 is separated from the gate terminal 5' of triac T to not conduct a current having flowed into the triac T.

Further, since the contact portion 3 of the movable piece 1 is separated from the circumference r of the cylindrical hole 4 in the fixed terminal 2, there is no arc generation between the contact portions 3, 3' and the circumference r, r' of the cylindrical holes 4, 4' in the fixed terminals 2, 2' thereby preventing damage to the contact. In other words, the triac T is turned off to avoid arc generation, and the space between the fixed terminals 2 and 2' is completely in an open state between the power supply terminal 2 and the load terminal 2' to isolate the triac T completely when the switch is opened, thereby maintaining its security.

The present invention, which employs a semi-conductor device to prevent arc generation, has a difference in the circuit configuration between the fixed contacts 2, 2' as main contacts and the triac T as a semiconductor device and in the working effect thereof, compared to the prior art, and accordingly provides a solution to the many drawbacks in which attended industrial use of the existent device. In other words, according to the present invention the problems in the prior art whereby insulation destruction of the semiconductor device in the state of opening a switch is possible since the triac is electrically connected between the load side and the power supply; and also the cost rise due to the use of silver contacts, may be eliminated completely.

Further, a triac is used in the described embodiment, but when the power supply is a d.c. source the present invention may be used to connect the collector of a transistor to a subsidiary terminal 8; the emitter of same to the fixed terminal 2' as a load side; and the base of same to another subsidiary terminal 8', without departing from the scope and spirit of the present invention.

What is claimed is:

1. An arc-free electromagnetic contactor comprising: first and second fixed terminals, each fixed terminal having a hole therethrough; insulating means secured to said first and second fixed terminals, said insulating means having first and second holes therethrough, said first and second holes respectively communicating with said holes in said first and second fixed terminals; first and second conductive pins mounted on said insulating means for displacement in a first direction from a first position to a second position thereof; first and second means for respectively urging said first and second conductive pins in a direction opposite to said first direction; switching means having first and second terminals respectively electrically coupled to said first conductive pin and to said second fixed terminal, and having a gate terminal electrically coupled to said second conductive pin, said gate terminal controlling the connection between said first and second terminals of said switching means; movable conductive bridge means having first and second contact means; and means for moving said bridge means, said first contact means contacting said first conductive pin and said first fixed terminal, and said second contact means contacting said second conductive pin when said bridge means is in first and second positions, and said second contact means further contacting said second fixed terminal only when said bridge means is in said second position, said second conductive pin being displaced in said first direction when said bridge means moves from said first position to said second position thereof, whereby current flows through said switching means when said bridge means is in said first position, and current flows from said first fixed terminal to said second fixed terminal by way of said bridge means when said bridge means is in said second position.

2. The contactor as defined in claim 1, wherein said first and second contact portions respectively contact said holes of said first and second fixed terminals along a circle when said bridge means is in said second position.

3. The contactor as defined in claim 1, wherein said means for moving said bridge means comprises an electromagnet connected by a voltage source by way of a switch.

4. The contactor as defined in claim 1, wherein said switching means comprises a semiconductor device.

5. The contactor as defined in claim 1, wherein said switching means comprises a triac.

6. The contactor as defined in claim 1, wherein said first and second fixed terminals are offset by a predetermined distance.

* * * * *